US007604057B1

(12) United States Patent
Eriksen et al.

(10) Patent No.: US 7,604,057 B1
(45) Date of Patent: Oct. 20, 2009

(54) INCREMENTAL U-TUBE PROCESS TO RETRIEVE OF BOTTOM HOLE ASSEMBLY DURING CASING WHILE DRILLING OPERATIONS

(75) Inventors: Erik P. Eriksen, Calgary (CA); Michael E. Moffitt, Houston, TX (US); Tommy M. Warren, Coweta, OK (US)

(73) Assignee: Tesco Corporation (US), Houston, TX (US)

( * ) Notice: Subject to any disclaimer, the term of this patent is extended or adjusted under 35 U.S.C. 154(b) by 0 days.

(21) Appl. No.: 12/125,808

(22) Filed: May 22, 2008

(51) Int. Cl.
*E21B 19/00* (2006.01)
*E21B 23/08* (2006.01)

(52) U.S. Cl. ..... 166/377; 166/383; 166/385

(58) Field of Classification Search ..... 166/377, 166/383, 385
See application file for complete search history.

(56) References Cited

U.S. PATENT DOCUMENTS 2,997,119 A 8/1961 Goodwin
2007/0051538 A1 3/2007 Angman et al.
2007/0068677 A1 3/2007 Angman et al.

FOREIGN PATENT DOCUMENTS

WO WO 2007/140612 A1 12/2007

OTHER PUBLICATIONS

Yakov A. Gelfgat, Mikhail Y. Gelfgat and Yuri S. Lopatin, authors "Advanced Drilling Solutions Lessons from the FSU", vol. II, The Definitive Book on Russian Drilling Technology Table of Contents, 2 pgs.,—pp. 390-394—1 additional pg.

D.J. Bode, R.B. Noffke and H.V. Nickens, authors "Well-Control Methods and Practices in Small-Diameter Wellbores", JPT Nov. 1991, pp. 1380-1386.

*Primary Examiner*—David J Bagnell
*Assistant Examiner*—Yong-Suk Ro
(74) *Attorney, Agent, or Firm*—Bracewell & Giuliani LLP

(57) ABSTRACT

A bottom hole assembly is retrieved through a casing string by lightening the density of the drilling fluid in the casing string above the bottom hole assembly to a lesser density than the drilling fluid in the casing string annulus. The bottom hole assembly moves upward in the casing string in response to an upward force created by the different densities of fluid. While moving upward, less dense fluid being displaced by the upward movement of the bottom hole assembly flows from the casing string. When the bottom hole assembly stops moving upward, slips suspended it at that intermediate point in the casing string. The operator now lightens the density of the drilling fluid in the casing string below the bottom hole assembly, again creating an upward force on the bottom hole assembly that causes the bottom hole assembly to move upward in the casing string.

20 Claims, 11 Drawing Sheets

INCREMENTAL U-TUBE PROCESS TO RETRIEVE OF BOTTOM HOLE ASSEMBLY DURING CASING WHILE DRILLING OPERATIONS

FIELD OF THE INVENTION

This invention relates in general to drilling boreholes with casing-while-drilling operations and in particular to methods for retrieving the bottom hole assembly.

BACKGROUND OF THE INVENTION

Casing-while-drilling is a technique that involves running the casing at the same time the well is being drilled. The operator locks a bottom hole assembly to the lower end of the casing. The bottom hole assembly has a pilot drill bit and a reamer for drilling the borehole as the casing is lowered into the earth. The operator pumps drilling mud down the casing string, which returns up the annulus surrounding the casing string along with cuttings. The operator may rotate the casing with the bottom hole assembly. Alternatively, the operator may employ a mud motor that is powered by the downward flowing drilling fluid and which rotates the drill bit.

When the total depth has been reached, unless the drill bit is to be cemented in the well, the operator will want to retrieve it through the casing string and install a cement valve for cementing the casing string. Also, at times, it may be necessary to retrieve the bottom hole assembly through the casing string prior to reaching total depth to replace the drill bit or repair instruments associated with the bottom hole assembly. One retrieval method employs a wireline retrieval tool that is lowered on wireline into engagement with the bottom hole assembly. The operator pulls upward on the wireline to retrieve the bottom hole assembly. While this is a workable solution in many cases, in some wells, the force necessary to pull loose the bottom hole assembly and retrieve it to the surface may be too high, resulting in breakage of the cable.

In another method, the operator reverse circulates to pump the bottom hole assembly back up the casing. One concern about reverse circulation is that the amount of pressure required to force the bottom hole assembly upward may be damaging to the open borehole. The pressure applied to the annulus of the casing could break down certain formations, causing lost circulation or drilling fluid flow into the formation. It could also cause formation fluid to flow into the drilling fluid and be circulated up the casing string.

SUMMARY OF THE INVENTION

In this method of retrieving a bottom hole assembly through casing string in a casing-while-drilling operation, the operator lightens the density of the column of fluid in the casing string above the bottom hole assembly to a lesser density than the column of fluid in the casing string annulus. The bottom hole assembly moves upward in the casing string in response to an upward force created by the denser column of fluid in the casing string annulus than the column of fluid in the casing string above the bottom hole assembly. If upward movement ceases when the bottom hole assembly is only partly up the casing, downward movement of the bottom hole assembly is prevented. The operator then lightens the density of the column of fluid in the casing string below the bottom hole assembly, again creating an upward force on the bottom hole assembly that causes the bottom hole assembly to move upward in the casing string.

Preferably lightening the density is accomplished by pumping a fluid with less density than the fluid in the annulus down the casing string and through the bottom hole assembly while it is prevented from moving downward in the casing string. During the upward movement, the operator maintains the casing string annulus substantially full of fluid. Preferably, the displaced fluid flowing up the casing string flows through a restrictive orifice of a choke to control the rate at which the bottom hole assembly moves upward.

In one embodiment, the bottom hole assembly is prevented from downward movement by frictionally engaging the casing string with a frictional device attached to the bottom hole assembly. In another embodiment, the operator measures the quantity of fluid flowing into the casing string annulus and measures the quantity of displaced fluid flowing out of the casing string as the bottom hole assembly moves upward. The operator at least temporarily stops retrieval of the bottom hole assembly if the difference between the two flow rates exceeds a selected minimum. In still another embodiment, the operator assists the upward force by attaching a wireline to the bottom hole assembly and pulling upward on the bottom hole assembly.

DETAILED DESCRIPTION OF THE INVENTION

Figure 1:
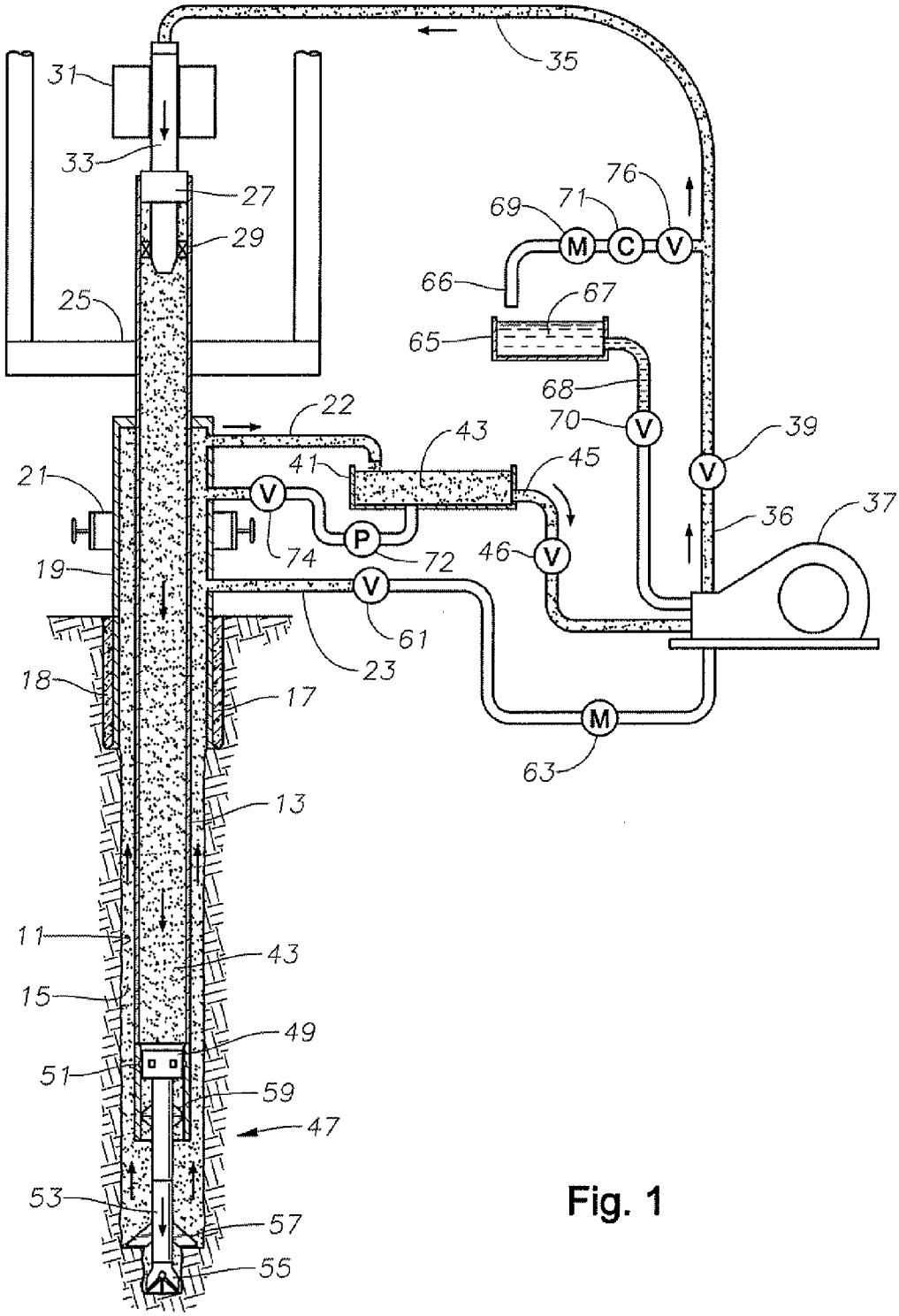
FIG. 1 is a schematic view illustrating a drilling system for practicing a method of this invention and shown in a drilling mode

Referring to FIG. 1, a borehole 11 is shown being drilled. A casing string 13 is lowered into borehole 11. An annulus 15 is located between the sidewall of borehole 11 and casing string 13. One or more strings of casing 17 have already been installed and cemented in place by cement 18, although the drawings shows only one casing string for convenience. Annulus 15 thus extends from the bottom of casing string 13 up the annular space between casing string 13 and casing 17.

A wellhead assembly 19 is located at the surface. Wellhead assembly 19 will differ from one drilling rig to another, but preferably has a blowout preventer 21 (BOP) that is capable of closing and sealing around casing 17. An annulus outlet flowline 22 extends from wellhead assembly 19 at a point above BOP 21. An annulus inlet flowline 23 extends from wellhead assembly 19 from a point below BOP 21.

Casing string 13 extends upward through an opening in rig floor 25 that will have a set of slips (not shown). A casing string gripper 27 engages and supports the weight of casing string 13, and is also capable of rotating casing string 13. Casing string gripper 27 may grip the inner side of casing string 13, as shown, or it may alternately grip the outer side of casing string 13. Casing string gripper 27 has a seal 29 that seals to the interior of casing string 13. Casing string gripper 27 is secured to a top drive 31, which will move casing string gripper 27 up and down the derrick. A flow passage 33 extends through top drive 31 and casing gripper 27 for communication with the interior of casing string 13.

A hose 35 connects to the upper end of flow passage 33 at top drive 31. Hose 35 extends over to a discharge port 36 of a mud pump 37. Mud pump 37 may be a conventional pump that typically has reciprocating pistons. A valve 39 is located at outlet 36 for selectively opening and closing communication with hose 35. The drilling fluid circulation system includes one or more mud tanks 41 that hold a quantity of drilling fluid 43. The circulation system also has screening devices (not shown) that remove cuttings from drilling fluid 43 returning from borehole 11. Mud pump 37 has an flowline inlet 45 that connects to mud tank 41 for receiving drilling fluid 43 after cuttings have been removed. A valve 46 selectively opens and closes the flow from mud tank 41 to an inlet of mud pump 37. A centrifugal charging pump (not shown) may be mounted in flowline 45 for supplying drilling fluid 43 to mud pump 37. Mud pump 37 may have an outlet that is connected to annulus fill line 23 for pumping fluid down casing annulus 15 and back up the interior of casing string 13.

A bottom hole assembly 47 is shown located at the lower end of casing string 13. Bottom hole assembly 47 may include a drill lock assembly 49 that has movable dogs 51 that engage an annular recess in a sub near the lower end of casing string 13 to lock bottom hole assembly 47 in place. Drill lock assembly 49 also has keys that engage vertical slots for transmitting rotation of casing string 13 to bottom hole assembly 47. Dogs 51 could be eliminated, with the bottom hole assembly 47 retained at the lower end of casing string 13 by drilling fluid pressure in casing string 13. An extension pipe 53 extends downward from drill lock assembly 49 out the lower end of casing string 13. A drill bit 55 is connected to the lower end of extension pipe 53, and a reamer 57 is mounted to extension pipe 53 above drill bit 55. Alternately, reamer 57 could be located at the lower end of casing string 13. Logging instruments may also be incorporated with extension pipe 53. A centralizer 59 centralizes extension pipe 53 within casing string 13.

During drilling, mud pump 37 receives drilling fluid 43 from mud tank 41 and pumps it through outlet 36 into hose 35, as illustrated in FIG. 1. The drilling fluid flows through casing gripper 27, down casing string 13 and out nozzles at the lower end of bit 55. Drilling fluid 43 flows back up casing annulus 15 and through return flow line 22 back into mud tank 41.

The schematic of FIG. 1 shows also a valve 61 and a flow meter 63 located in annulus inlet flowline 23. During normal drilling operations, as shown in FIG. 1, no flow will be flowing through annulus inlet 23. Another tank 65, this one containing a less dense fluid 67, is shown in FIG. 1. Less dense fluid 67 has a lower density than drilling fluid 43 and is used during the retrieval process. For example, less dense fluid 67 may be water, which has a lesser density and weight per gallon than typical drilling fluid 43. The inlet line 66 to less dense fluid tank 65 connects to hose 35. A flow meter 69 is preferably located in inlet line 66. Also, a choke 71 is preferably located in inlet line 66. Choke 71 has a restrictive, variable diameter orifice. Chokes of this nature are commonly used for drilling and well control in general. A valve 76 may be located between mud hose 35 and choke 71 to block flow to choke 71. Tank 65 has an outlet line 68 that contains a valve 70 and which leads to an inlet of mud pump 37.

A fill-up pump 72, which is normally a centrifugal pump, may be connected in a fill-up lines extending from mud tank 41 and casing annulus 15. A valve 74 may be located in the fill-up line between fill-up pump 72 and casing annulus 15. The outlet of fill-up pump 72 preferably enters casing annulus 15 above BOP 21 since fill-up pump 72 is not used to apply surface pressure to the fluid in annulus 15.

Figure 2:
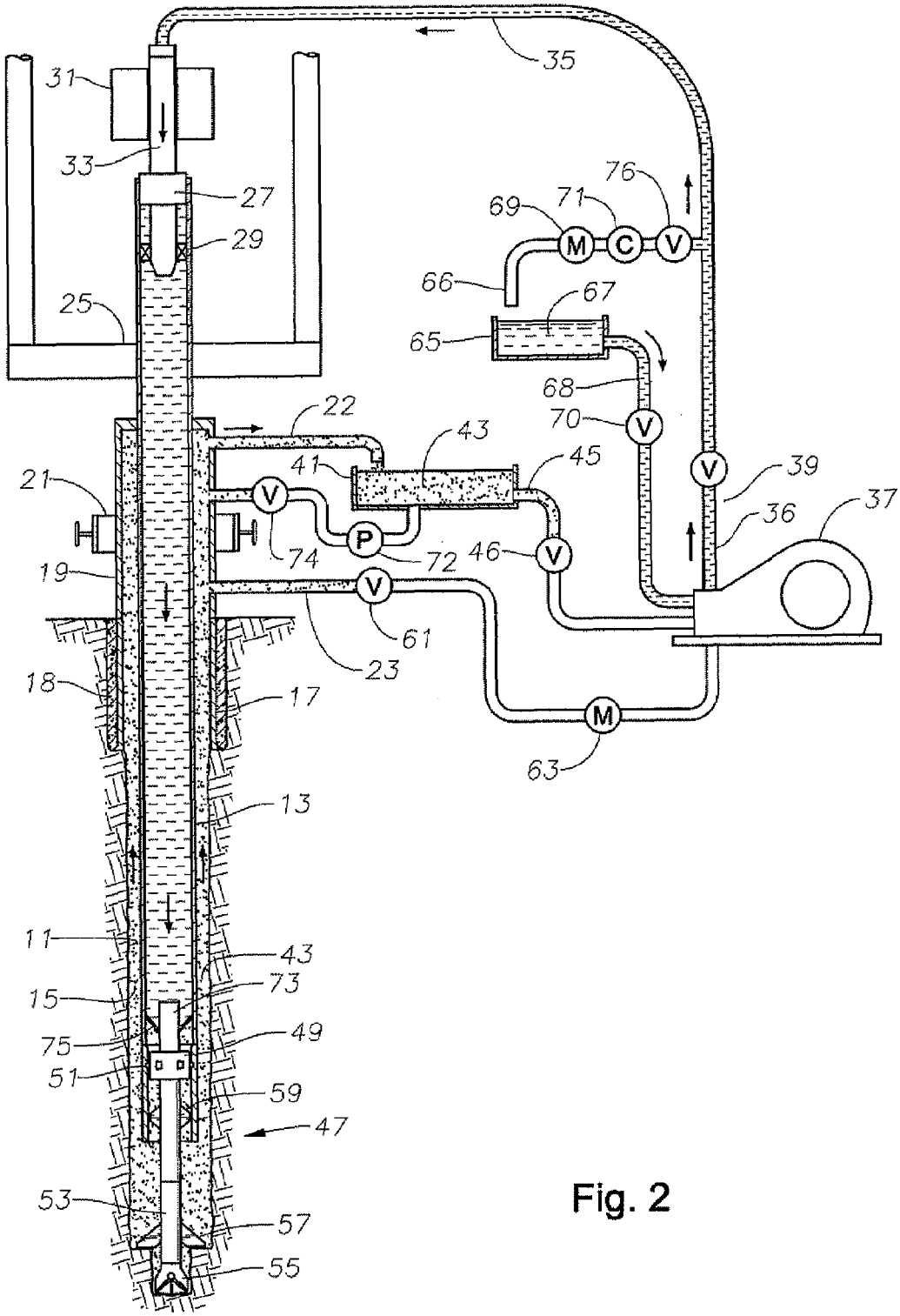
FIG. 2 is another view of the schematic of FIG. 1, showing a retrieval tool that has been pumped down into engagement with the bottom hole assembly with a less dense fluid than the fluid in the annulus.

Referring to FIG. 2, a retrieval tool 73 is shown in engagement with bottom hole assembly 49. Retrieval tool 73 preferably has a seal 75 that seals to the inner diameter of casing string 13. This arrangement allows the operator to pump retrieval tool 73 down casing string 13 and into engagement with drill lock assembly 49. Alternately, seal 75 could be omitted and retrieval tool 73 conveyed down casing string 13 by gravity. If seal 75 is employed, it need not form a tight seal against casing string 13. The retrieval tool 73 latches to drill lock assembly 49 and also releases dogs 51 to allow bottom hole assembly 47 to be retrieved. FIG. 2 illustrates retrieval tool 73 after being pumped down with less dense fluid 67 drawn from tank 65 and pumped by mud pump 37 through hose 35.

Figure 6:
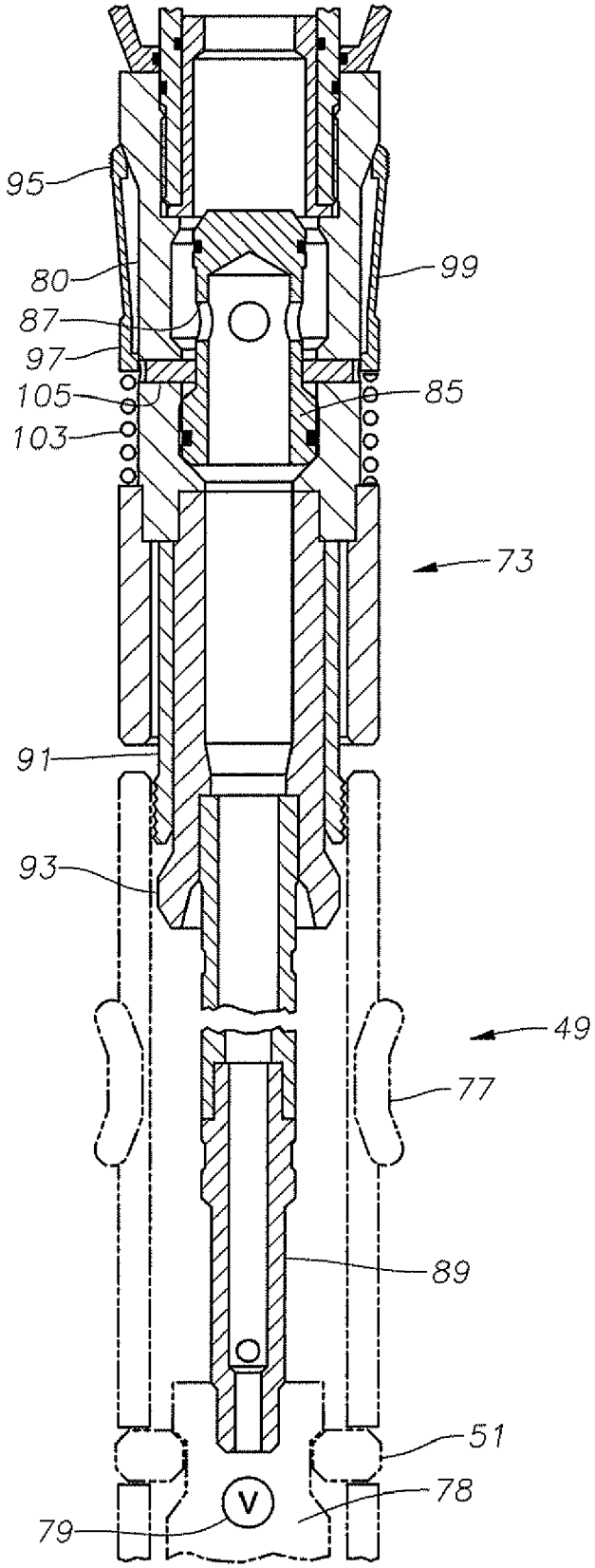
FIG. 6 is a further enlarged view of a portion of the retrieval tool of FIG. 3 and shown engaging a bottom hole assembly, shown by dotted lines.

Referring to FIG. 6, the dotted lines schematically illustrate that drill lock assembly 49 has optionally a set of seals 77 that enable drill lock assembly 49 to be pumped down along with extension pipe 53 and drill bit 55 (FIG. 1). Alternately drill lock assembly 49 could have been installed in casing string 13 while casing string 13 is being made up. Seals 77 may comprise cup seals that face both upward and downward and engage the inner diameter of casing string 13 (FIG. 1) for sealing against upward as well as downward pressure. It is not necessary that seals 77 form tight sealing engagement with casing string 13, as some leakage past would be permissible.

Drill lock assembly 49 also has a mandrel 78 that moves upward and downward relative to an outer housing of drill lock assembly 49. When mandrel 78 is in the lower position shown in FIG. 6, dogs 51 retract. When in the upper position, dogs 51 will extend out and engage a recess in casing string 13. Furthermore, drill lock assembly 49 has a check valve 79, shown schematically in FIG. 6. Check valve 79 will allow downward flow through drill lock assembly 49 but prevent upward flow.

Figure 3:
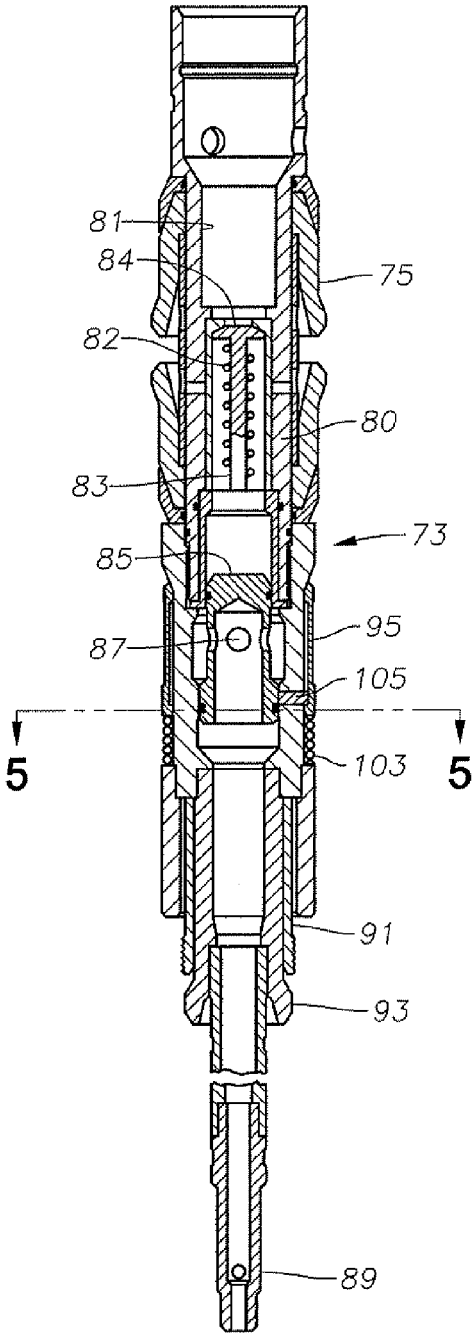
FIG. 3 is an enlarged sectional view of the retrieval tool schematically illustrated in FIG. 2.

Referring to FIG. 3, an example of retrieval tool 73 is shown. Seals 75, if employed, may be similar to seals 77 (FIG. 6); that is, seals 75 are preferably cup-shaped, with the upper seal facing downward and the lower seal facing upward. Seals 75 will slidingly engage and seal to the inner diameter of casing string 13 (FIG. 2), but need not seal tightly.

Retrieval tool 73 has a body 80 formed of multiple pieces that has a flow passage 81 extending through it. A check valve 83 is located within flow passage 81. Check valve 83 may be constructed similar to check valve 79 (FIG. 6). In this embodiment, check valve 83 has a spring 82 that urges a valve element 84 against a seat. Check valve 83 allows downward flow in passage 81 but not upward flow.

Figure 5:
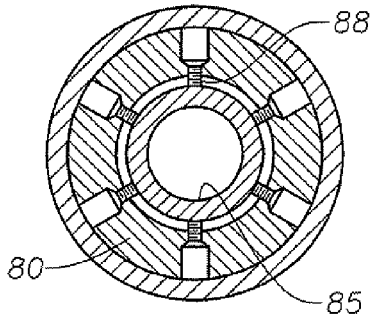
FIG. 5 is a sectional view of a retrieval tool of FIG. 3, taken along lines 5-5 of FIG. 3.

A plug 85 is mounted in flow passage 81. Plug 85 moves between a closed position shown in FIG. 3 and an open position shown in FIG. 6. In the closed position, flow through passage 81 is blocked, both in an upward and in a downward direction. When moved downward to the open position, flow can circulate around an annular recess through flow ports 87 and down passage 81. Plug 85 is preferably initially held in the closed position by a plurality of shear pins 88 (FIG. 5). Downward acting fluid pressure on plug 85 of sufficient magnitude will shear the shear pins 88.

Retrieval tool 73 also has a release member 89 that is employed to release drill lock assembly 49 (FIG. 6) from the locked position. In this instance, release member 89 comprises an elongated tube that extends downward and into drill lock assembly 49 as retrieval tool 73 lands on drill lock assembly 49. Release member 89 contacts mandrel 78 and pushes it downward to the released position. Others types of release mechanisms are feasible and could include grapples that pull upward on a portion of the drill lock assembly rather than being a downward acting tool.

A retrieval tool latch or gripper 91 is mounted to retrieval tool 73 for gripping or latching to drill lock assembly 49. In this embodiment, retrieval tool gripper 91 comprises a collet type member with an annular base at its upper end and a plurality of fingers. Each finger has a gripping surface on its exterior for gripping the inner diameter of the housing of drill lock assembly 49. The fingers of gripper 91 are backed up by a ramp surface 93 located at the lower end of body 80 within gripper 91. Gripper 91 is able to slide down and out a portion of ramp surface 93 to tightly engage drill lock assembly 49. Retrieval toot 73 thus supports the weight of drill look assembly 49 when drill lock assembly 49 is suspended below.

Figure 4:
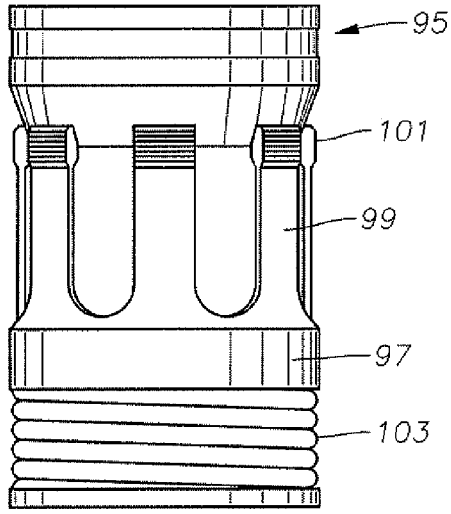
FIG. 4 is a side elevational view of the slips and spring employed with the retrieval tool of FIG. 3, and shown detached from the retrieval tool.

A friction type member 95, referred to herein as "slips" for convenience, is mounted to body 80 of retrieval tool 73. Slips 95 comprise a gripping or clutch device that moves between a retracted position, shown in FIG. 3 and an engaged position shown in FIG. 6. As shown in FIG. 4, slips 95 comprise in this example a collet type member having an annular base 97 and a plurality of upward extending fingers 99. Each finger 99 has a gripping surface 101 on its outer surface. Fingers 99 slide upward and outward on ramp surface 93 when moving to the gripping position. A coil spring 103 urges fingers 99 upward to the gripping position. When retrieval tool 73 moves upward, gripping surfaces 101 slide on the inner diameter of casing string 13. When retrieval tool 73 starts to move downward, fingers 99 wedge between ramp surface 93 and the casing string 13 inner diameter to suspend retrieval tool 73. Other arrangements for a friction mechanism that allows upward movement but suspends the retrieval tool when moving downward are feasible.

A retainer mechanism initially will hold slips 95 in the retracted position. In this example, the retainer mechanism comprises a plurality of pins 105 (only one shown). Each pin 105 extends laterally through an opening in body 80 and is able to slide radially inward and outward relative to body 80. Each pin 105 has an outer end that engages an annular recess in the inner diameter of base 97. The inner end of each pin 105 is backed up or prevented from moving radially inward by plug 85 when plug 85 is in the blocking position shown in FIG. 3. When plug 85 moves to the open position shown in FIG. 6, pins 105 are released to slide inward, which frees slips 95 to be pushed upward by spring 103. Other mechanisms are feasible for retaining slips 95 in the retracted position while retrieval tool 73 is being pumped down casing string 13 (FIG. 1).

In operation of the embodiment of FIGS. 1-10, when it is desired to retrieve bottom hole assembly 47, the operator drops retrieval tool 73 down casing string 13, as shown in FIG. 2, followed by less dense fluid 67. Less dense fluid 67, typically water, flows into pump inlet 68 and is pumped by mud pump 37 through hose 35 down casing string 13. Valves 46, 61, 74 and 76 will be closed and valve 39 open. Retrieval tool 73 will be configured as in FIG. 3 while being pumped in, with slips 95 retracted and plug 85 in the upper blocking position.

Referring to FIG. 6, release member 89 contacts drill lock mandrel 78 and pushes it downward, which allows dogs 51 to retract from locking engagement with casing string 13. Continued downward fluid pressure from mud pump 37 causes plug 85 to shear pins 88 and move from the position in FIG. 3 to the position in FIG. 6. The downward movement of plug 85 frees slips 95, which are pushed by spring 103 outward into engagement with casing string 13. Gripper 91 will be in engagement with the inner diameter of the housing of drill lock assembly 49, which secures retrieval tool 73 to drill lock assembly 49, making the assembly a retrievable unit. The operator then ceases to pump less dense fluid 67, but will initially block back flow through choke 71.

Figure 9:
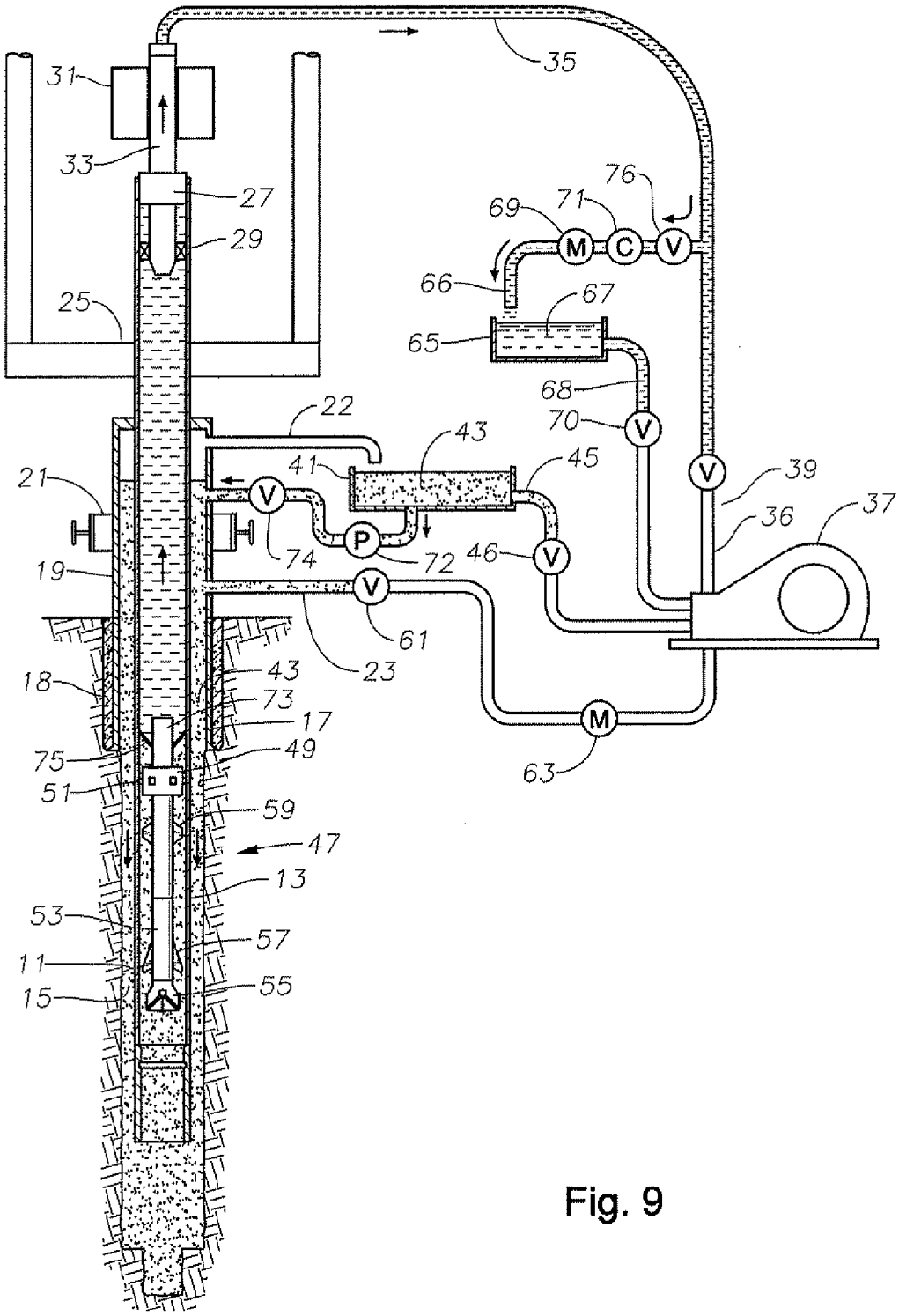
FIG. 9 is another schematic view similar to FIG. 2, but showing the retrieval tool and bottom hole assembly moved partially up the casing string in response to the weight of the denser fluid in the casing annulus than the less dense fluid in the casing.

The heavier weight of drilling fluid 43 in annulus 15 exerts an upward acting force against seals 77 on drill lock assembly 49 (FIG. 6) because drill lock assembly check valve 79 prevents upward flow through drill lock assembly 49. The more dense drilling fluid 43 in annulus 15 tends to "U-tube", pushing less dense fluid 67 up and out casing string 13 until reaching an equilibrium. To enable U-tubing to occur, at the surface the operator closes valves 39, 70 and 61, as shown in FIG. 9. Valves 74 and 76 are opened. The operator begins to open the orifice of choke 71, which allows less dense fluid 67 from casing 13 to flow upward through hose 35, through flow meter 69 and choke 71 and into less dense fluid tank 65, as shown in FIG. 9.

The level of drilling fluid 43 in annulus 15 would drop as it begins to U-tube, and to prevent it from dropping, the operator should continue to add a heavier fluid, such as drilling fluid 43, to annulus 15 to maintain annulus 15 full. In this example, the operator will cause fill-up pump 72 to flow drilling fluid 43 through annulus inlet 23 into annulus 15, as shown in FIG. 9. The flow rate should be only sufficient to keep the level of fluid 43 in annulus 15 from dropping.

The operator may monitor the flow rate of the returning less dense fluid 67 with flow meter 69 as well as the flow rate of the drilling fluid 43 flowing into annulus 15. Unless there is some overflow of drilling fluid 43 at the surface, these flow rates should be equal. The quantity of drilling fluid 43 flowing into annulus 15 should substantially equal the quantity of displaced less dense fluid 67 flowing through choke 71. If more drilling fluid 43 has been added to annulus 15 at any given point than the less dense fluid 67 bled back through choke 71, it is likely that some of the drilling fluid 43 is flowing into an earth formation in borehole 11. If less drilling fluid 43 has been added at any given point than the less dense fluid 67 bled back through choke 71, it is likely that some of the earth formation fluid is flowing into the annulus 15. Neither is desirable.

Bottom hole assembly 47 and retrieval tool 73 will move upward as a retrievable unit during the U-tubing occurrence. The operator controls choke 71 to a desired flow rate as indicated by meter 69, which also is proportional to the velocity of bottom hole assembly 47. This velocity should be controlled to avoid the downward flow in annulus 15 being sufficiently high so as to damage any of the open formation in borehole 1. Eventually, the operator will open the flow area of choke 71 completely.

Figure 10:
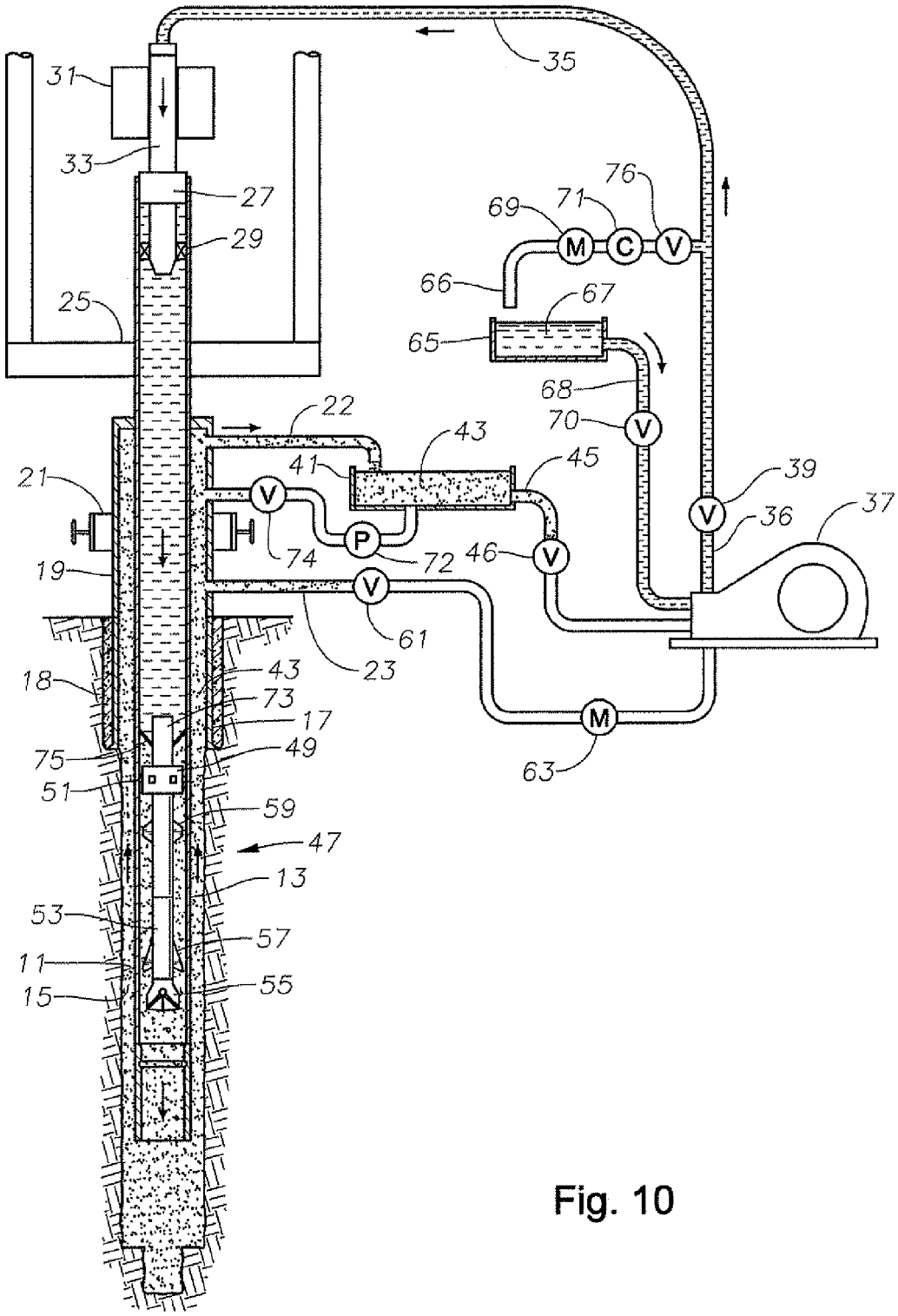
FIG. 10 is a schematic view similar to FIG. 9, but showing the bottom hole assembly and retrieval tool suspended by slips as the operator pumps less dense fluid down through the bottom hole assembly to refill the casing.

As the drilling fluid 43 in casing annulus 15 flows into casing string 13, the pressure acting upward on bottom hole assembly 47 will eventually drop to a level that is inadequate to further push bottom hole assembly 47 upward, and it will stop at an intermediate position in casing string 13, as shown in FIG. 10. When it stops, slips 95 (FIG. 3) will prevent downward movement of the bottom hole assembly 47. Slips 95 will be engaging casing string 13 as bottom hole assembly 47 moves upward, thus once it ceases upward movement, slips 95 will immediately prevent downward movement. The operator will detect the cessation of movement by flow meter 69, which will show substantially zero flow rate at that point.

Referring to FIG. 10, while bottom hole assembly 47 is held by slips 95 in the intermediate position, the operator then pumps more of the less dense fluid 67 down casing string 13. The less dense fluid 67 flows through bottom hole assembly 47 and preferably down to substantially the lower end of casing. The operator will control the amount of fluid pumped in so as to avoid pumping large amounts of less dense fluid 67 up casing annulus 15, although some overfill is feasible. The operator pumps the less dense fluid 67 downward with mud pump 37 through hose 35. Valve 70 will be open for drawing less dense fluid 67 from tank 65 into the intake line 68 of pump 37. Valves 46, 61, 74 and 76 will be closed. The downward pumping of less dense fluid 67 pushes the drilling fluid 43 that had previously U-tubed up into casing string 13 back up casing annulus 15. The displaced drilling fluid 43 flows out annulus return 22 into mud tank 41.

Once casing string 13 is again substantially filled with less dense fluid 67, the cumulative weight of drilling fluid 43 in annulus 15 will again exceed the cumulative weight of less dense fluid 67 in casing 15 plus the weight of bottom hole assembly 47. The operator then repeats the steps in FIG. 9 to again create a U-tube flow, which causes the bottom hole assembly 47 to move upward again as less dense fluid 67 is displaced out the upper end of casing string 13. The operator will repeat these U-tube steps until bottom hole reaches casing gripper 27.

Figure 11:
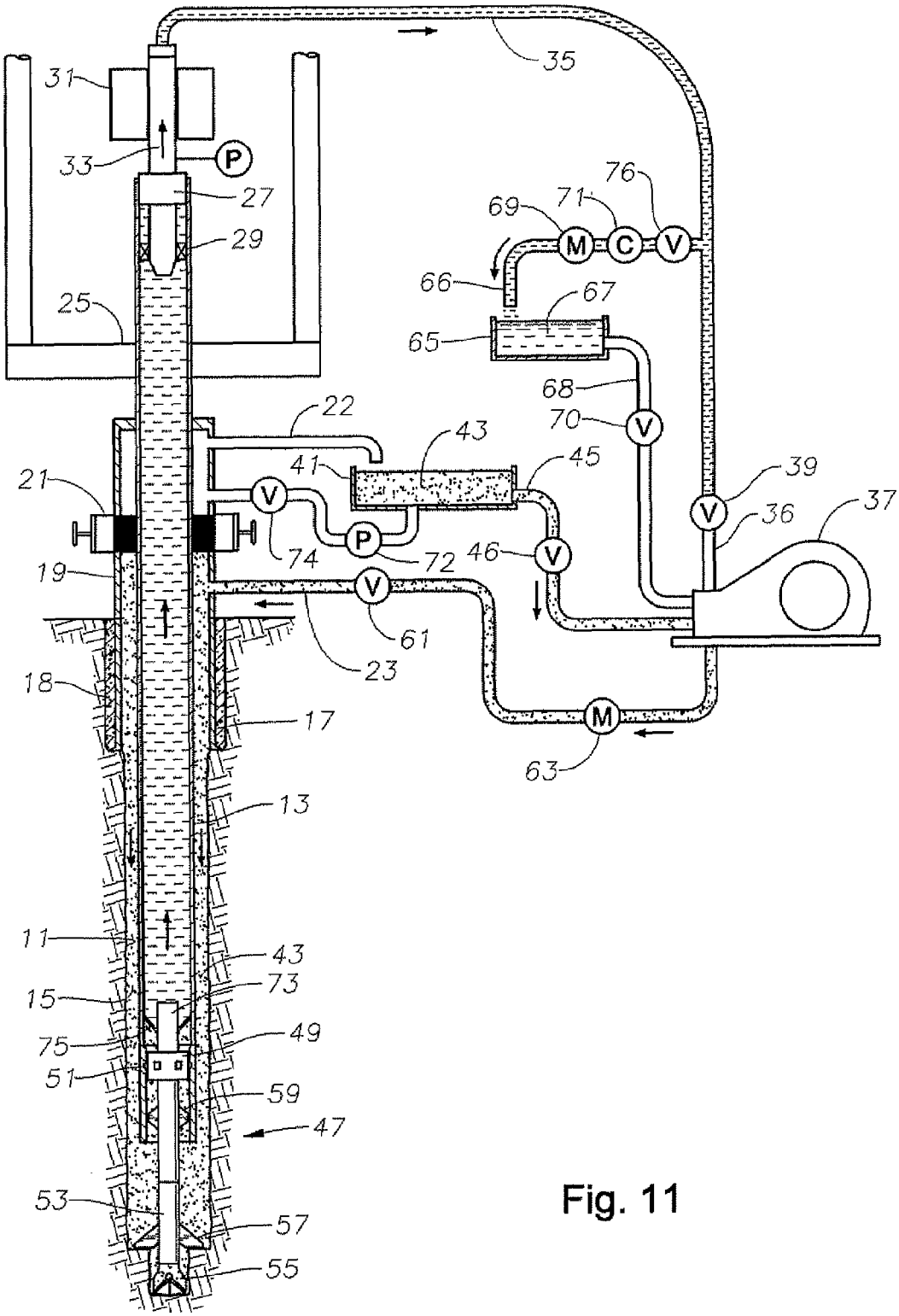
FIG. 11 is a schematic view similar to FIG. 9, but showing the blowout preventer closed and the operator applying surface pressure to the drilling fluid in the annulus.

FIG. 11 illustrates the same equipment as in FIGS. 1-10, however rather than filling annulus 15 while BOP 21 is open, BOP 21 is closed and mud pump 37 is used to pump drilling fluid 43 into annulus 15. Valve 61 is open and valves 39, 70, 74 and 76 are closed. Therefore, some surface pressure will exist at the upper end of annulus 15. This surface pressure will be monitored by the existing pressure gauge of mud pump 37 and also metered by flow rate meter 63. The more dense fluid 43 plus the surface pressure creates U-tube flow, with less dense fluid 67 flowing back through choke 71. The embodiment of FIG. 11 operates in the same manner as described in connection with the embodiments of FIGS. 1-10, other than applying a positive surface pressure to annulus 15.

Figure 7:
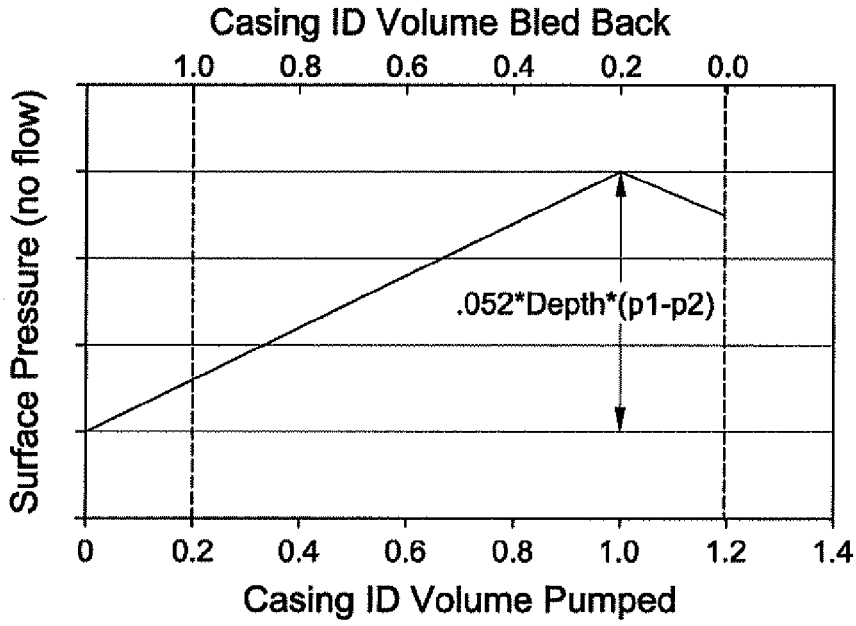
FIG. 7 is a graph illustrating energy required to cause heavier annulus fluid to push a bottom hole assembly upward in casing filled with a less dense fluid.
Figure 8:
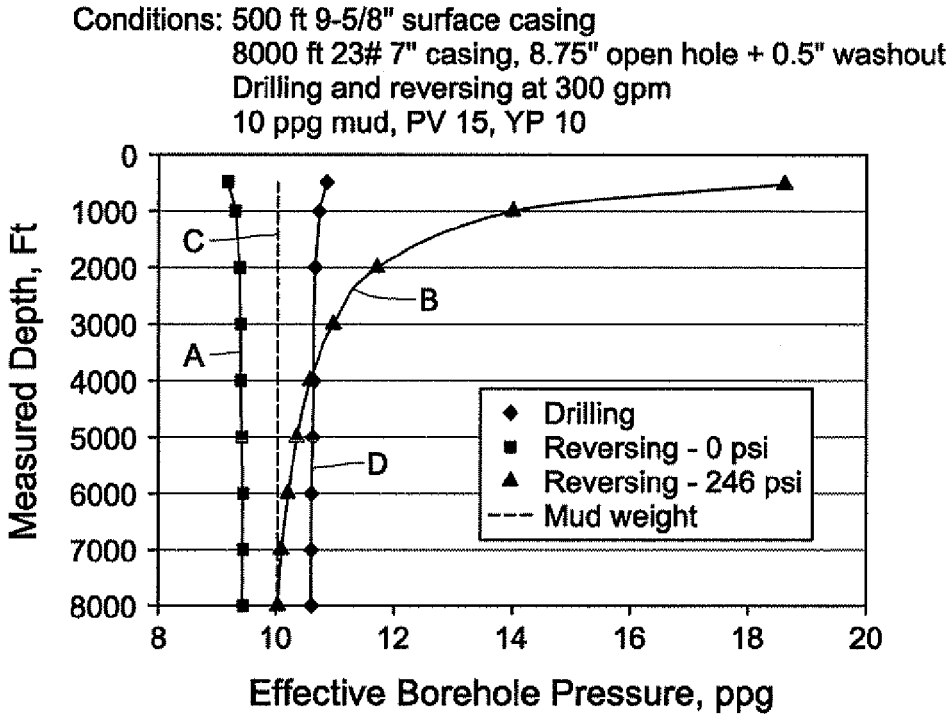
FIG. 8 is a graph illustrating effective borehole hydrostatic pressure during various stages of this invention.

FIGS. 7 and 8 are graphs illustrating the advantage of lightening the density of fluid in casing string 13 (FIG. 1) when retrieving bottom hole assembly 47 (FIG. 1). Referring also to FIGS. 2 and 9, FIG. 7 shows schematically the surface pressure that exists at the surface, such as at choke 71, due to heavier fluid 43 in annulus 15 than in casing string 13. FIG. 7 designates the density of the heavier fluid 43 in pounds per gallon as being P1 and the density of the less dense fluid 67 in pounds per gallon as being P2. The pressure force is equal to the depth times 0.052 times the difference between the two densities P1 and P2. The heavier fluid is generally the drilling fluid or mud being used to drill the well.

Once the less dense fluid 67 has filled casing string 13, as shown in FIG. 2, the heavier fluid 43 in annulus 15 will exert an upward force tending to push more dense fluid 43 back out of casing string 13. When this occurs, drill lock assembly 49 will move upward with the less dense fluid 67 flowing out of casing string 13. The amount of pressure available for pushing bottom hole assembly 47 upward is due to the difference in the densities of less dense fluid 67 and more dense fluid 43. As indicated by the curve in FIG. 7, the greatest pressure exists when casing string 13 is completely filled with less dense fluid and the annulus 15 completely filled. At this point, which is designated by the numeral 1 under the legend "Casing ID Volume Pumped", the greatest surface pressure, such as at choke 71 (FIG. 2), will exist. As bottom hole assembly 47 moves upward, the available energy to keep it moving upward decreases proportional to the distance it is moved. When all of the less dense fluid has been bled back (or U-tubed), the surface pressure at choke 71 would be zero, and the portion of casing string 13 below bottom hole assembly 47 would be filled with the heavier fluid 43.

One problem with this technique is that if only the fluid in the inner diameter of casing string 13 is displaced with less dense fluid 67, the energy available to overcome the weight of bottom hole assembly 47 plus the mechanical friction in the casing string 13 is insufficient to transport the bottom hole 47 from the bottom of casing string 13 all the way to the surface. This problem can be overcome by "over-displacing" the casing string 13 with the less dense fluid 67, as shown in FIG. 7. The term "over-displaced" means that more of the less dense fluid is pumped into the casing string than casing string 13 can hold, causing some of the less dense fluid 67 to flow up the casing annulus 15. For example, if the inner diameter of casing string 13 is over-displaced by 20% (shown by the numeral 1.2 on the graph of FIG. 7), the maximum available surface pressure for transporting bottom hole assembly 47 occurs after it has moved 20% up casing string 13. The maximum pressure occurs once all of the overfilled less dense fluid 67 has moved from annulus 15 back into casing string 13. If the amount of over displacement is proportional to the weight of bottom hole assembly 47, a single U-tube occurrence may be sufficient to transport bottom hole assembly 47 from the bottom of casing string 13 all the way to the surface. FIG. 7 shows some surface pressure in existence when an amount equal to the volume of the casing string has been bled back. If that surface pressure is sufficient to support the weight of bottom hole assembly 47 while it is at the surface, the U-tube flow would be able to transport bottom hole assembly 47 from the bottom to the surface in one occurrence. This assumes that casing annulus 15 is continually filled or topped up with higher density fluid 43 as the less dense fluid 67 is bled from casing string 13.

Additional pressure for bottom hole assembly 47 transport can also be generated by filling casing annulus 15 with a fluid having a density greater than P1 or by closing blowout preventer 21 and adding surface pressure with mud pump 37, as in FIG. 11. In either case, the open portion of borehole 11 may be exposed to a higher pressure than it is desirable. In the embodiment of FIGS. 1-10, bottom hole assembly 47 is transported to the surface in a plurality of stages or steps, wherein lesser dense fluid 67 is replaced in casing string 13 after it flows back from casing string 13 sufficiently so that the transport energy is dissipated.

When the flow path is open for less density fluid 67 to flow out of the top of casing string 13, the fluid will accelerate to a velocity that creates a zero net force balance. Assuming that annulus 15 is kept full of high density fluid 43, the major forces involved are the hydraulic friction of the fluid flowing downward in the annulus 15, the pressure force required to support the weight of bottom hole assembly 47 and the mechanical friction of moving bottom hole assembly 47 of casing 13. Also, hydraulic friction pressure exists in the circulation system at the surface. The sum of these pressures is equal to the potential pressure shown in FIG. 7 for any position of bottom hole assembly 47 in casing string 13. If the surface equipment pressure losses were negligible, bottom hole assembly 47 would accelerate upwards until the frictional pressure loss in casing annulus 15 plus the bottom hole assembly support pressure is equal to the pressure shown in FIG. 1.

The frictional pressure in annulus 15 acts in a direction to oppose the fluid flow, thus it tends to reduce well bore pressure in annulus 15. The maximum reduction in pressure occurs at the bottom of casing string 13. The reduction in pressure below the hydrostatic head of the fluid used to drill the well may create borehole instability or induce an influx of formation fluid into casing string 13. Neither occurrence is desirable. The undesirable effect can be negated by incorporating a device to regulate the flow of fluid from casing string 13 so that the velocity of the downward flowing fluid in annulus 15 is controlled to a desirable range. In the preferred embodiment, this regulation is handled by gradually opening adjustable choke valve 71 (FIG. 2). As bottom hole assembly 47 is transported to the surface, the bottom hole assembly 47 velocity can be maintained constant.

FIG. 8 shows an example of the effective pressure exerted on the open hole portion of borehole 11 while U-tubing a bottom hole assembly in a 7" diameter casing string. The simulation is for a flow rate of 300 gallons per minute and mud weight of 10 lbs. per gallon at 8,000 ft. depth, as indicated by curve C. While drilling and flowing 300 gallons per minute, the pressure exerted on the open hole portion of borehole 11 is relatively constant at 10.6 lbs. per gallon, as indicated by curve D. The annular pressure loss is 246 psi. Two separate U-tubing cases are evaluated. In both cases, the complete casing string 13 is displaced with water, which would provide a 695 psi potential to start the reversing process. This pressure is equivalent to an upward force of 22,000 lbs on bottom hole assembly 47. Referring also to FIG. 2, curve A assumes that annulus 15 is kept full of 10 lbs. per gallon drilling fluid, but there is no additional pressure at the surface applied to annulus 15. The return fluid flows through choke 71, which is used to throttle the flow initially significantly, but is continuously opened as the well U-tubes to maintain approximately 300 gallons per minute flow measured by flow meter 69.

At some point near the surface, it will not be possible to maintain this flow rate as the potential energy of the differential density is dissipated. The wellbore pressure is generally about 9.4 lbs. per gallon or about 1.2 lbs. per gallon less than when drilling and 0.6 lbs. per gallon less than when the well is static. By comparison, if casing string 13 were to be abruptly open to atmosphere as the U-tube process is started, the bottom hole pressure would fall to the equivalent of 8.3 lbs. per gallon, or even less if the dynamic forces are considered.

Curve B simulates closing well annulus 15 in at the surface, such as with blowout preventer 21 as illustrated in FIG. 11. Curve B simulates pumping into the well at a constant flow rate of 300 gallons per minute. Choke 71 is operated to maintain a constant pressure of 246 psi on casing annulus 13 at the surface. For this case, the bottom hole pressure is exactly the same as the hydrostatic well pressure of curve A, but the formation of borehole 11 near the lower end of casing 17 is exposed to substantially higher pressure. In some cases, it may be desirable to add a slight surface pressure to annulus 15 by pumping into the annulus as in FIG. 11 to overcome any reduction and effective hydraulic pressure due to friction.

In a particular situation, knowledge of the formation sensitivities may be used to determine the most critical point in the well bore for preventing an inflow of drilling fluid into an earth formation or well bore instability due to changes in pressure in annulus 15. If the annulus 15 frictional loss is calculated from the surface to the most critical point using the flow rate that provides the most desirable bottom hole assembly 47 transport rate, fluid can be injected into annulus 15 at this flow rate. Choke 71 is adjusted to maintain a pump 37 pressure equal to calculated annulus 15 loss. These steps will cause the annulus pressure at the bottom of borehole 11 to be maintained at the hydrostatic pressure of the annulus fluid.

It is desirable to keep annulus 15 full of drilling fluid when circulating out bottom hole assembly 47. This can be done by an open system or with a closed system. An example of an open system is by using fill-up pump 72 (FIG. 9) to return drilling fluid into the top of annulus 15. The pump rate would not be critical as long as it achieved the rate needed to replace the fluid in casing annulus 15 that would normally drop as fluid 67 flows out of casing 13. An example of a closed system is shown in FIG. 11, wherein BOP 21 is closed to allow surface pressure to be applied by mud pump 37. In FIG. 11, mud pump 37 is operating, valves 61 and 76 are open and valves 39, 70 and 74 are closed.

Figure 12:
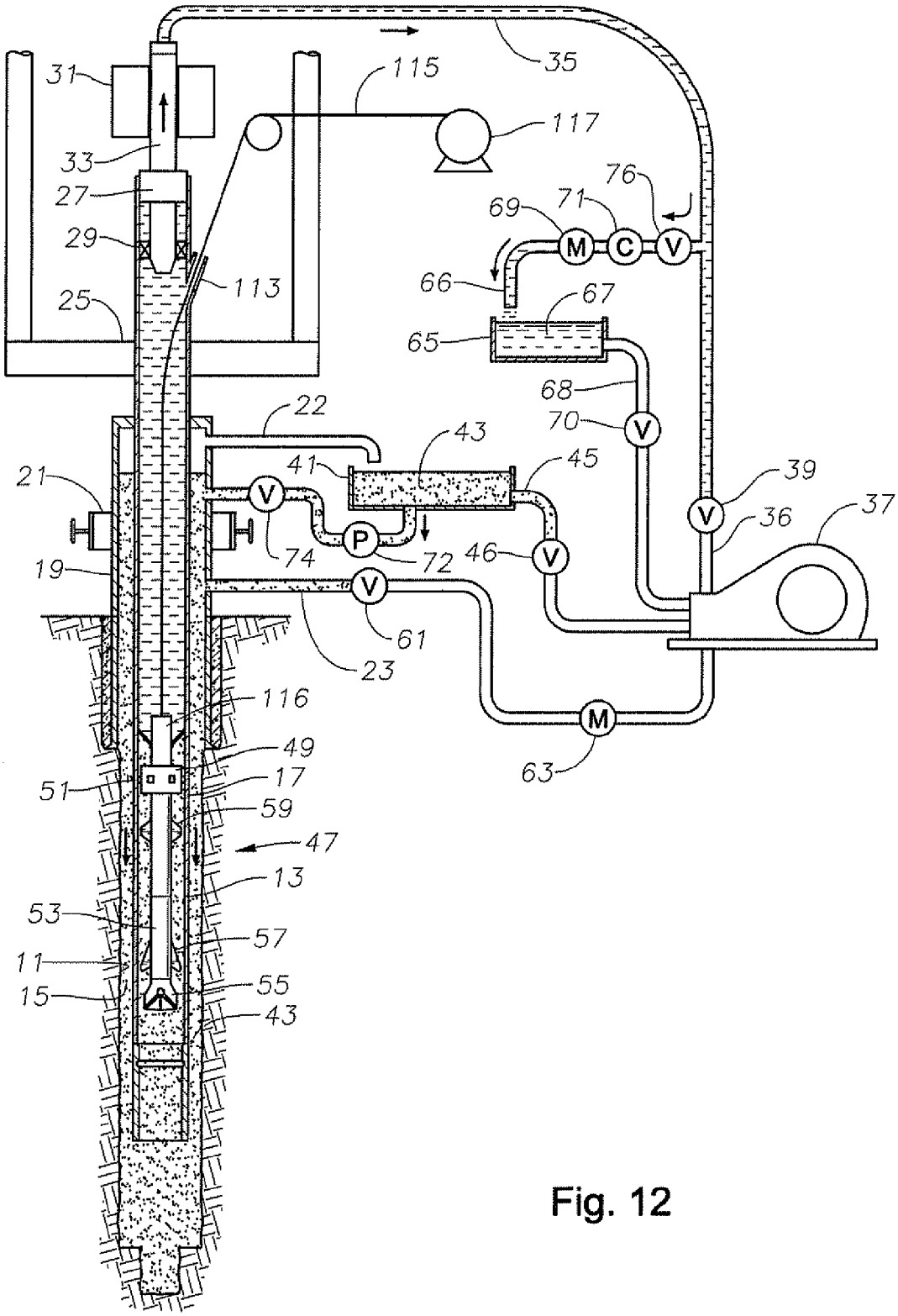
FIG. 12 is a schematic view similar to FIG. 9, but illustrating the operator employing a wireline or cable in addition to reverse circulating.

In FIG. 12, rather than rely solely on the U-tubing effect to push bottom hole assembly 47 to the surface in stages, a cable or wireline 115 will be employed to assist the upward force due to the heavier fluid flowing down casing annulus 15. Wireline 115 passes through a wireline entry sub 113 that will be mounted at the upper end of casing string 13 below casing gripper 27. Wireline 115 has a retrieval unit 116 on its end that may be pumped and latched into engagement with bottom hole assembly 47. Wireline 115 extends over a sheave to a drum 117 that pulls upward on bottom hole assembly 47. Alternately, the wireline entry can be made between top drive 31 and casing string gripper 27 or above top drive 31.

In the operation of the embodiment of FIG. 12, retrieval unit 116 is pumped down and latched into engagement with bottom hole assembly 47 while it is attached to wireline 115 and wireline 115 fed out. Retrieval unit 116 releases the locking member of bottom hole assembly 47. Preferably, the operator pumps retrieval unit 116 downward or follows it with less dense fluid 67 so that casing string 13 will now be filled with less dense fluid 67. The more dense fluid 43 in casing annulus 15 will exert an upward force on the seals on bottom hole assembly 47. As indicated in FIG. 12, U-tubing occurs when valves 74 and 76 are open, fill-up pump 72 is operating, and valves 39, 70, 46 and 61 are closed. This upward force will be assisted by pulling upward on wireline 115. As wireline unit 116 and bottom hole assembly 47 start moving upward, the operator may control the rate of ascent by gradually opening choice 71. The operator maintains annulus 15 full of drilling fluid 43, preferably with fill-up pump 72.

When the force due to the heavier drilling fluid 43 in annulus 15 is inadequate to lift bottom hole assembly 47, the operator may continue pulling bottom hole assembly 47 upward with wireline 115.

Slips 95 (FIG. 3) may be used on retrieval tool 116 and the incremental U-tubing steps previously described used in conjunction with wireline 115. The arrangement of FIG. 12 avoids wireline 115 from having to supply all of the force to lift bottom hole assembly 47 when it is located at the bottom of casing string 13; while at the bottom, a greater force is required than at any other points because of the additional weight of wireline 115 in casing string 13. Also, bottom hole assembly 47 may tend to stick while at the bottom of casing string 13. In addition, the greatest weight of fluid acting downward on the seals of bottom hole assembly 47 exists when bottom hole assembly 47 is at the lower end of casing string 13. In addition, combining wireline 115 with incremental U-tubing steps allows the operator to use commercially available line of less strength than would otherwise be required.

Figure 13:
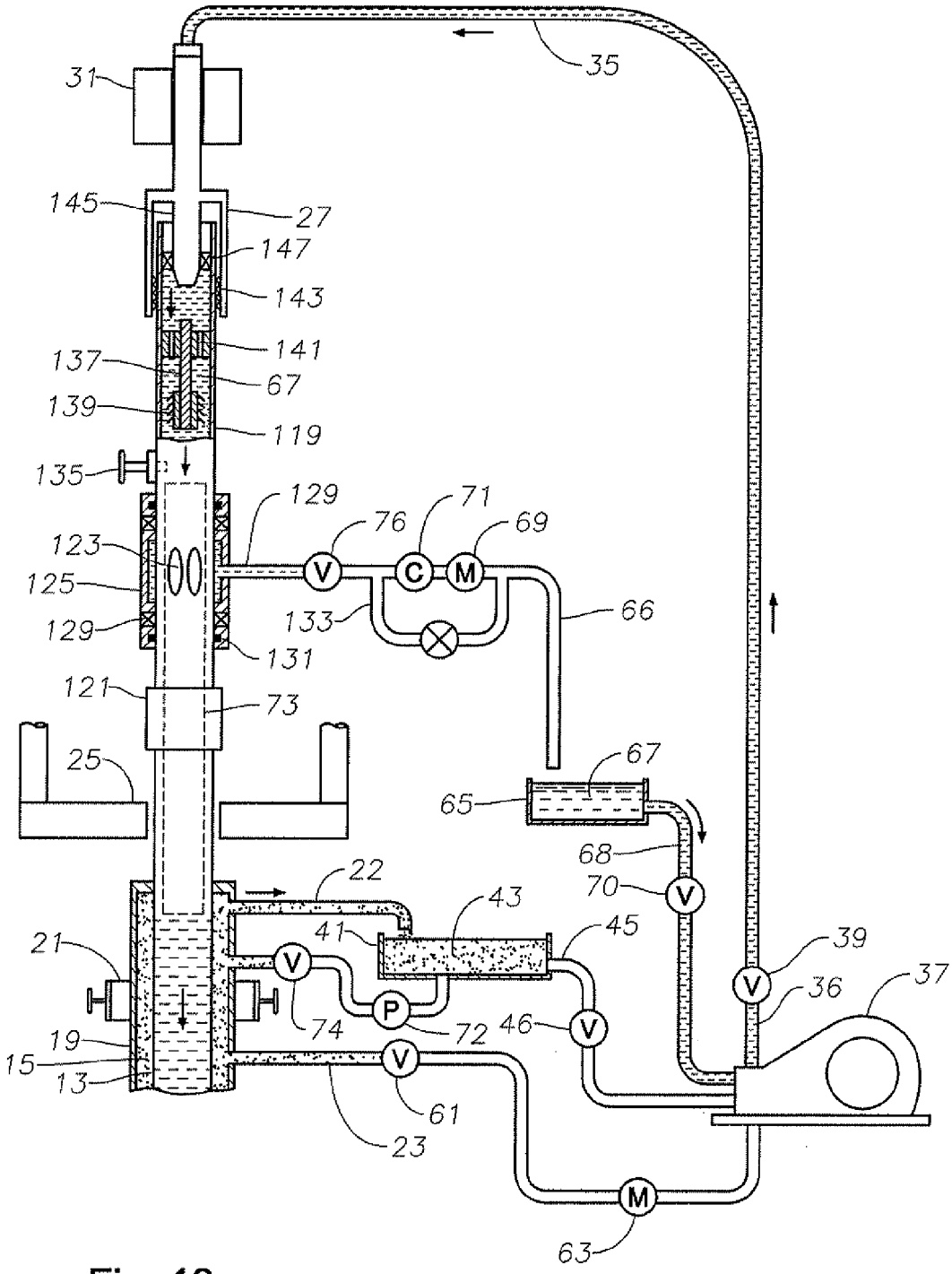
FIG. 13 is a schematic view illustrating an alternate arrangement of equipment at the rig for use in retrieving a bottom hole assembly.

Referring to FIG. 13, in this embodiment, hose 35 is not used for returning displaced fluid from casing string 13. Instead, when the operator wishes to commence retrieval, the operator will support casing string 13 in slips (not shown) at rig floor 25. The operator then disconnects casing string gripper 27 from casing string 13 and attaches casing string gripper 27 to a circulation sub 119. In the example of FIG. 13, circulation sub 119 is connected by an adapter 121 to the upper end of casing string 13. Circulation sub 119 has one or more outlet ports 123 in its sidewall. A swivel housing 125 preferably mounts around circulation sub 119. Swivel housing 125 is mounted on bearings 127 so as to allow circulation sub 119 to rotate relative to swivel housing 125, if desired. A tether (not shown) may attach swivel housing 125 to the rig to prevent its rotation. Swivel housing 125 is connected to an outlet flow line 129 that leads from its sidewall and which is in communication with outlet ports 123. Seals 131 are located above and below outlet ports 123 for sealing swivel housing 125 to circulation sub 119.

Outlet flowline 129 preferably leads to less dense tank 65 for discharging less dense fluid 67. Preferably flow meter 69 and choke 71, as well as valve 76 are mounted in outlet flowline 129. A bypass loop 133 may extend around flow meter 69 and choke 71 in order to protect meter 69 if a well control situation develops.

Circulation sub 119 may also have a latch pin 135 for latching into engagement with retrieval tool 73, shown by dotted lines. Latch pin 135 will hold retrieval tool 73 in circulation sub 119 until it is released. Circulation sub 119 may also contain a tool catcher 137 mounted therein. Catcher 137 has a grapple 139 on its lower end for engaging the upper end of retrieval tool 73 when it returns to the surface. Flow ports 141 extend through its mounting portion to allow downward flow through circulation sub 119.

In this example, casing string gripper 27 is shown as an external type that has gripping members 143 that grip the exterior of sub 119. Alternately, it could have a gripper that grips the inner diameter of sub 119. A spear 145 extends downward from casing gripper 27 into the upper end of circulation sub 119. Spear 145 has a seal 147 that seals against the inner diameter of circulation sub 119.

In operation, FIG. 13 illustrates the operator beginning to pump retrieval tool 73 down for engagement with bottom hole assembly, which is not shown in FIG. 13, but which would be similar to bottom hole assembly 47 in FIG. 2. Latch pin 135 has just been released. Mud pump 37 is pumping less dense fluid; valves 39 and 70 are open and valves 46, 61 and 74 are closed. The fluid flows downward through hose 35 and acts against the seal 75 (FIG. 2) on retrieval tool 73. Alternately, if desired, light weight fluid 67 can be pumped into casing string 13 behind retrieval tool 73 through line 129. This would be desired if the less dense fluid was not compatible with the pumping system of the rig or if the rig operator preferred not to pump this fluid with mud pump 37. Also, pumping through line 129 may save rig time by not having to reroute the system components to the retrieval configuration once retrieval tool 73 reaches the bottom hole assembly.

Figure 14:
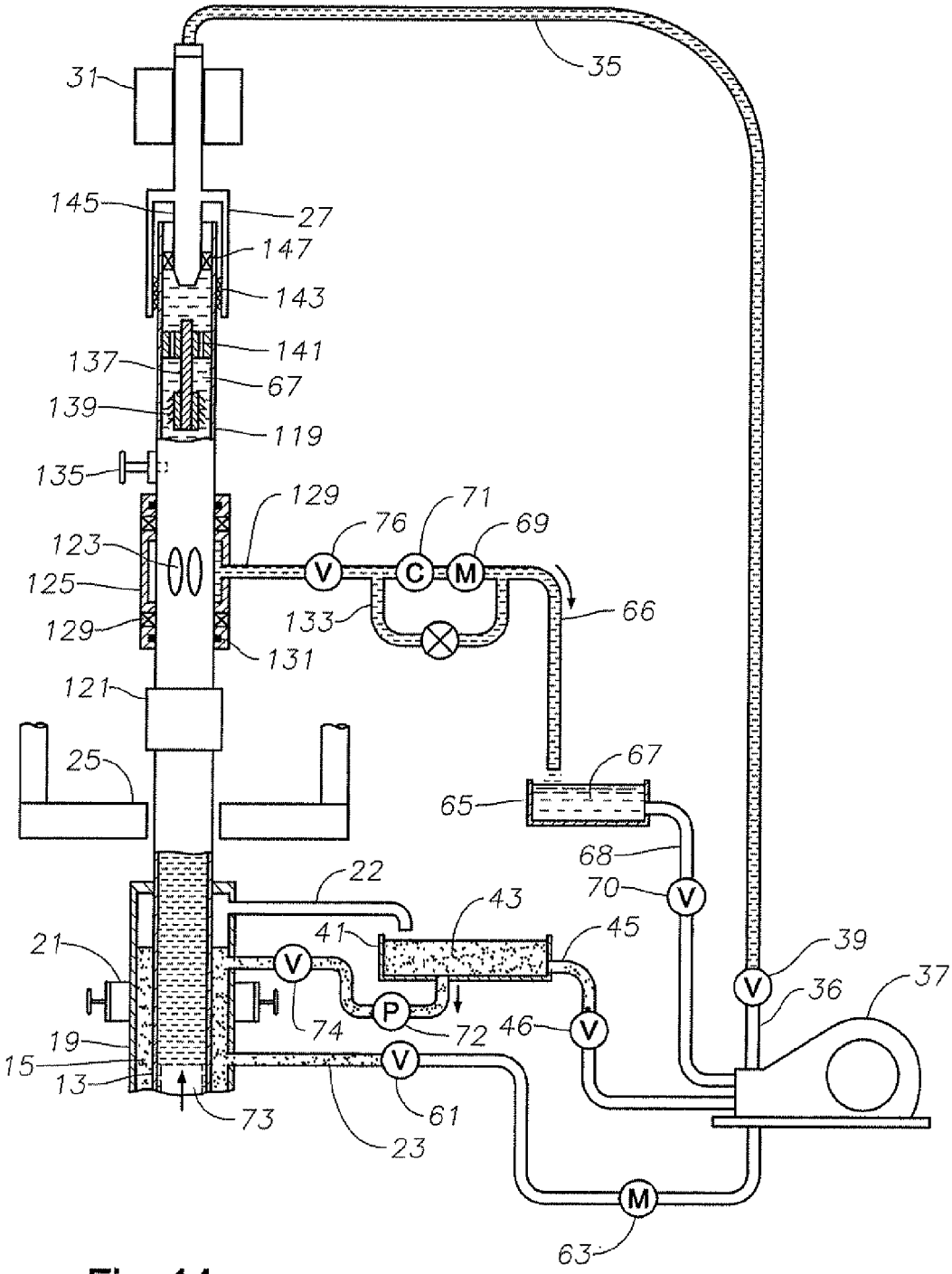
FIG. 14 is a view similar to FIG. 13, but showing the retrieval tool returning to the surface.

The operator then follows one or more of the methods of FIGS. 1-11. When retrieval tool 73 is returning to the surface, as shown in FIG. 14, fill-up pump 72 will be topping up casing annulus 15 with drilling fluid 43. The displaced less dense fluid 67 will flow out flowline 129 into less dense fluid tank 65. Valves 74 and 76 are open and valves 39, 61 and 70 are closed. The operator controls the velocity of the upward movement of retrieval tool 73 by varying the flow area of choke 71. When retrieval tool 73 reaches grapple 139, it will be caught and held in place along with bottom hole assembly 47 (FIG. 2). Preferably seal 75 (FIG. 3) on retrieval tool 73 will pass and locate above outlet ports 123 when engaged by grapple 139. As seals 75 pass outlet ports 123, a pressure differential will be observed because no additional fluid will be flowing out of outlet ports 123.

While the invention has been shown in several of its forms, it should be apparent to those skilled in the art that it is not so limited but it is susceptible to various changes without departing from the scope of the invention. For example, rather than flowing less dense fluid back into a tank, the operator could simply dispose of the fluid. Other ways exist to reduce the density of the fluid in the casing above the bottom hole assembly, such as injecting air into the casing while it is still filled with drilling fluid. The slips on the retrieving tool could be mounted on the drill lock assembly.

The invention claimed is:

1. A method of retrieving a bottom hole assembly through casing string in a casing-while-drilling operation wherein the casing string and a casing string annulus each contain a column of fluid, comprising:

(a) lightening the density of the column of fluid in the casing string above the bottom hole assembly to a lesser density than the column of fluid in the casing string annulus;

(b) moving the bottom hole assembly upward in the casing string in response to an upward force created by the denser column of fluid in the casing string annulus than the column of fluid in the casing string above the bottom hole assembly;

(c) preventing downward movement of the bottom hole assembly when the upward force becomes insufficient to continue satisfactory upward movement of the bottom hole assembly; then (d) lightening the density of the column of fluid in the casing string below the bottom hole assembly, again creating an upward force on the bottom hole assembly that causes the bottom hole assembly to move upward in the casing string.

2. The method according to claim 1, wherein step (d) comprises pumping a fluid with less density than the fluid in the annulus down the casing string and through the bottom hole assembly while it is prevented from moving downward in the casing string.

3. The method according to claim 1, wherein step (b) comprises maintaining the casing string annulus substantially full of fluid as the bottom hole assembly moves upward.

4. The method according to claim 1, wherein:

step (c) comprises gripping the casing string with lips attached to the bottom hole assembly.

5. The method according to claim 1, wherein step (c) occurs without applying any pressure at the surface to the column of fluid in the annulus.

6. The method according to claim 1, wherein:

step (d) comprises dispensing a quantity of fluid with less density than the fluid in the annulus down the casing string and through the bottom hole assembly while it is prevented from moving downward, the quantity of fluid being insufficient to flow out the bottom of the casing string into the annulus.

7. The method according to claim 1, wherein:

step (c) comprises flowing displaced fluid out of the casing string as the bottom hole assembly moves upward; and flowing the displaced fluid through a restrictive orifice of a choke and changing a flow area of the orifice while the bottom hole assembly moves upward to control the rate at which the bottom hole assembly moves upward.

8. The method according to claim 1, wherein step (b) further comprises:

flowing fluid into the casing string annulus that is more dense than the fluid in the casing string above the bottom hole assembly; and the method further comprises:

measuring the flow rate of fluid flowing into the casing string annulus;

measuring the flow rate of displaced fluid flowing out of the casing string as the bottom hole assembly moves upward; and at least temporarily stopping retrieval of the bottom hole assembly if the difference between the two flow rates exceeds a selected minimum.

9. The method according to claim 1, wherein step (b) comprises:

pumping fluid into the casing string annulus of substantially the same density as the fluid already contained in the casing string annulus as the bottom hole assembly moves upward, and applying a selected surface pressure to the column of fluid in the annulus.

10. The method according to claim 1, wherein step (b) further comprises assisting the upward force by attaching a wireline to the bottom hole assembly and pulling upward on the bottom hole assembly while the upward force in step (b) on the bottom hole assembly still exists.

11. A method of retrieving a bottom hole assembly through casing string in a casing-while-drilling operation wherein the casing string and a casing string annulus each contain a column of fluid, comprising:

(a) lightening the density of the fluid in the casing string above the bottom hole assembly to a lesser density than the fluid in the casing string annulus;

(b) moving the bottom hole assembly upward in the casing string in response to an upward force created by the fluid in the casing string annulus being heavier than the column of fluid above the bottom hole assembly;

(c) flowing fluid into the casing string annulus as the bottom hole assembly moves upward;

(d) flowing from the casing string less dense fluid being displaced by the upward movement of the bottom hole assembly;

(e) when the flow rate of the less dense fluid being displaced in step (d) drops below a selected level, suspending the bottom hole assembly in the casing string; then (f) while the bottom hole assembly is suspended, lightening the density of the fluid in the casing string below the bottom hole assembly without significantly changing the density of the fluid in the annulus, again creating an upward force on the bottom hole assembly that causes the bottom hole assembly to move upward in the casing string.

12. The method according to claim 11, wherein step (e) comprises:

pumping a less dense fluid than the fluid in the annulus down the casing string and through the bottom hole assembly while it is suspended in the casing string; and controlling the amount of the less dense fluid being pumped to limit less dense fluid from flowing into the annulus.

13. The method according to claim 11, wherein:

step (a) comprises mounting slips to a retrieving tool and pumping the retrieving tool down the casing string into latching engagement with the bottom hole assembly using a less dense fluid that is lighter in density than the fluid in the annulus; and step (d) comprises gripping the casing string with the slips of the retrieving tool.

14. The method according to claim 11, wherein step (c) occurs without applying any pressure at the surface to the fluid in the annulus.

15. The method according to claim 11, wherein step (d) comprises flowing the less dense fluid through a choke, and varying an orifice of the choke while the bottom hole assembly is moving upward to control the speed of the upward movement of the bottom hole assembly.

16. The method according to claim 11, further comprising:

measuring the flow rate of fluid flowing in the casing string annulus in step (c); and measuring the flow rate of displaced fluid flowing out of the casing string in step (d).

17. The method according to claim 11, wherein step (b) further comprises assisting the upward force by attaching a wireline to the bottom hole assembly and pulling upward on the bottom hole assembly while the upward force in step (b) on the bottom hole assembly still exists.

18. A method of retrieving a bottom hole assembly in a casing-while-drilling operation wherein the casing string and a casing string annulus contain a column of fluid, comprising:

(a) dropping a retrieving tool down the casing string and following it with a less dense fluid that is lighter in density than fluid in the annulus;

(b) latching the retrieving tool to the bottom hole assembly and unlocking the bottom hole assembly from the casing string with the retrieving tool, thereby creating a retrievable unit, the retrievable unit having slips that extend into engagement with the casing string to allow upward movement but not downward movement of the retrievable unit; then (c) moving the retrievable unit upward in the casing string in response to an upward force created by the fluid in the casing string annulus being heavier than the less dense fluid above the bottom hole assembly;

(d) flowing fluid into the casing string annulus as the retrievable unit moves upward;

(e) flowing from the casing string the less dense fluid being displaced by the upward movement of the retrievable unit; and (f) when the less dense fluid being displaced in step (e) substantially ceases flowing, pumping additional less dense fluid into the casing string below the retrievable unit while the retrievable unit remains suspended by the slips of the retrievable unit, the less dense fluid again creating an upward force on the bottom hole assembly that causes the retrievable unit to again move upward in the casing string.

19. The method according to claim 18, further comprising: measuring the flow rate of the fluid flowing into the casing string annulus in step (d); and and measuring the flow rate of less dense fluid flowing out of the casing string in step (e).

20. The method according to claim 18, wherein step (e) further comprises flowing the less dense fluid through a restrictive orifice of a choke and varying the orifice as the retrievable unit moves upward.

* * * * *